United States Patent [19]

Satoma

[11] Patent Number: 4,917,033

[45] Date of Patent: Apr. 17, 1990

[54] THREAD GUIDING DEVICE FOR A ROTARY LOOPER THREAD TAKE-UP

[75] Inventor: Shiro Satoma, Chofu, Japan

[73] Assignee: Juki Corporation, Tokyo, Japan

[21] Appl. No.: 175,490

[22] Filed: Mar. 30, 1988

[51] Int. Cl.[4] ..... D05B 57/04; D05B 57/06

[52] U.S. Cl. ..... 112/302; 112/199; 112/248; 112/254

[58] Field of Search ..... 112/199, 248, 302, 200, 112/202, 254

[56] References Cited

U.S. PATENT DOCUMENTS

| | | | |
|---|---|---|---|
| 3,552,678 | 1/1971 | DuRoss | 112/302 X |
| 4,249,580 | 2/1981 | Budzyna | 112/254 |
| 4,325,314 | 4/1982 | Niem | 112/199 |
| 4,492,174 | 1/1985 | Kaufmann | 112/248 |
| 4,633,795 | 1/1987 | von Hagen | 112/248 |
| 4,688,501 | 8/1987 | Mikuni et al. | 112/254 |
| 4,813,363 | 3/1989 | Wacker et al. | 112/248 X |

*Primary Examiner*—Andrew M. Falik

*Attorney, Agent, or Firm*—Morgan & Finnegan

[57] ABSTRACT

A cam shaft of a rotary looper thread take-up is extended short of a thread guide and thus provides a free space there-between. A thread introduced from the tip-end-side of the cam shaft is prevented from being entangled into the cam shaft when the looper thread becomes broken. In a preferred embodiment, three slit-like guides placed in parallel and two cams placed there-between are effective to introduce the looper thread into the rotary looper thread take-up by a simple operation without requiring an operator to visually align the thread to pass through an eyelet.

8 Claims, 7 Drawing Sheets

THREAD GUIDING DEVICE FOR A ROTARY LOOPER THREAD TAKE-UP

BACKGROUND OF THE INVENTION

This invention relates to an overedge sewing machine and more particularly to the guiding of a looper thread to a rotary looper thread take-up in such a sewing machine.

As an example of a conventional-type of looper thread take-up in overedging sewing machines, U.S. Pat. No. 4,492,174 (Kaufmann 1985; titled "Thread Control Mechanism For Sewing Machines") discloses one type of rotary looper thread take-up. Referring to FIG. 3 herein, which is a partial view of the conventional embodiment of FIG. 1 of U.S. Pat. No. 4,492,174, a looper thread T is introduced to a rotary looper thread take-up mechanism 32 from the right side of the drawing of FIG. 3 as shown in the arrow. The thread T is then passed through a looper 24.

Numeral 40 denotes a thread cam and is fixed to a shaft 22. The thread cam 40 is shaped as an eccentric semi-circle as shown in FIG. 4, so that when the shaft 22 rotates clockwise, the looper thread T is drawn from the right side to the rotary take-up mechanism 32.

Referring to FIG. 4, which is a side view drawing viewed from the arrow $Y_1$–$Y_2$ in FIG. 3, and FIG. 5 which is a top view drawing of FIG. 4, the rotary take-up mechanism 32 will now be explained in more detail. Numeral 36 denotes a slot opening provided in a support plate 38. Numerals 42 and 44 denote thread guides having thread eyes provided therein. The thread guides are fixed to the support plate 38 by screws 46. Each thread guide 42, 44 is provided with an oblong hole 48 such that their positions in relation to the support plate 38 may be adjusted. Numeral 50 denotes a stripping finger which is adjustably carried by the plate 38, and is situated between two thread cams 40, such that the thread is moved along the bottom edge of the stripping finger as the thread cams 40 rotate. Accordingly, looper thread feeding is conducted. The rotary looper thread take-up mechanism also works to take-up slack on the looper thread.

However, the aforementioned conventional-types of rotary take-up for the looper thread have the following demerits:

(1) Uneasy guiding of looper thread to the rotary take-up.

Since the rotary thread is eyed through two eyes $E_1$ $E_2$, guiding of the looper thread to the rotary take-up is not easy.

(2) Spinning of the looper thread.

When the looper thread becomes broken, the rotating cam 40 picks up the loose thread and winds it up. Often, by the time an operator has noticed the break, a large quantity of thread is wound up, thus requiring a long period of time to remove the wound thread.

According to U.S. Pat. No. 4,492,174, a pneumatic apparatus was provided to direct a stream of air against the rotary take-up, and thus hopefully the loose thread would be prevented from becoming entangled in the rotating shaft. According to another patent, U.S. Pat. No. 4,633,795 (von Hagen 1987; entitled "Looper Thread Control With Anti-Spin Cutting Knives"), when the thread is broken accidentally, a knife, located on at least one side of rotary cam and having a cutting edge disposed generally parallel to the rotational axis, cuts the thread and thus the unnecessary winding up of thread would hopefully be prevented. U.S. Pat. No. 4,325,314 (Niem 1982) discloses an alternative earlier method for breaking an entangled thread.

It is therefore an object of the invention to eliminate the aforementioned and other demerits of conventional rotary looper thread take-ups used for overedging sewing machines.

SUMMARY OF THE INVENTION

These and other objects of the invention are met by providing a thread guiding device for a rotary looper thread take-up wherein a cam shaft of a rotary looper thread take-up is extended short of a thread guide and thus provides a free space there-between. A thread introduced from the tip-end-side of the cam shaft is prevented from being entangled into the cam shaft when the looper thread becomes broken. In a preferred embodiment, three slit-like guides placed in parallel and two cams placed there-between are effective to introduce the looper thread into the rotary looper thread take-up by a simple one-step hand operation without requiring an eyeing step.

BRIEF DESCRIPTION OF THE DRAWINGS

The invention will be described in greater detail below by way of reference to the accompanying drawings, in which.

DETAILED DESCRIPTION OF THE DRAWINGS

Figure 1:
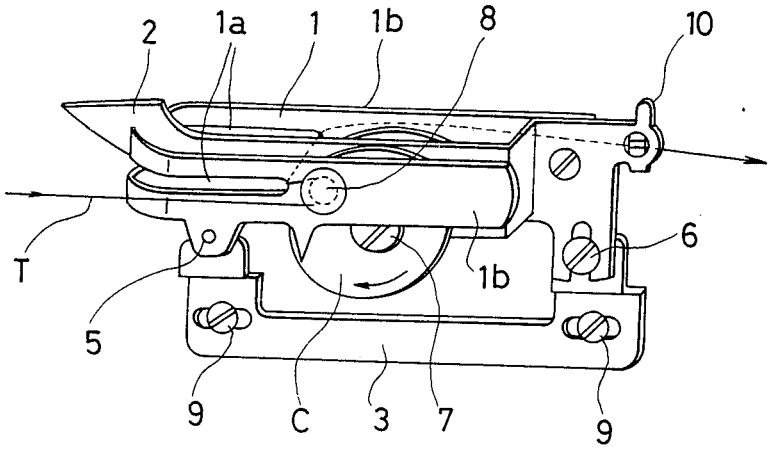
FIG. 1 is a perspective view of a rotary looper thread take-up according to the invention with a looper thread being introduced.
Figure 2A:
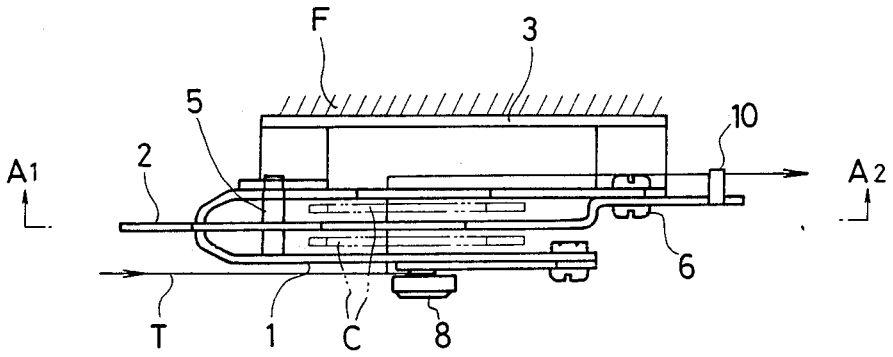
FIG. 2A is a plan view of the embodiment of FIG. 1.
Figure 2B:
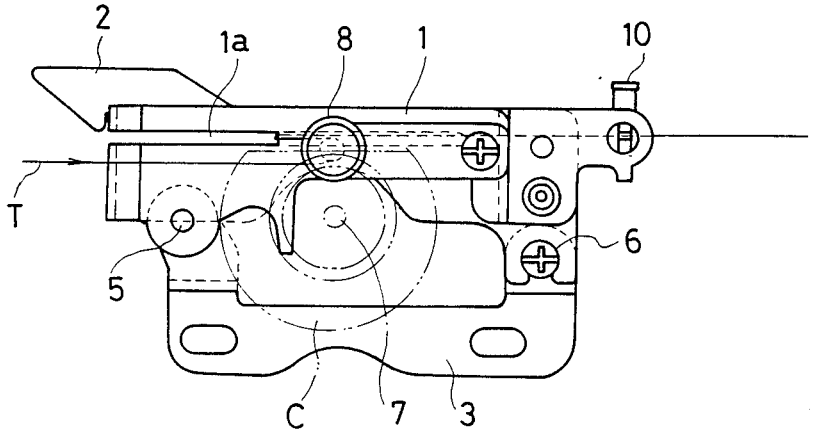
FIG. 2B is a front view of the embodiment of FIG. 1.

Referring to FIG. 1, numeral 1 refers to a first thread guide which is U-shaped when plan-viewed as shown in FIG. 2A. The first thread guide 1 provides a slit 1*a* on both sides 1*b* such that a looper thread T may be passed therethrough.

Figure 2C:
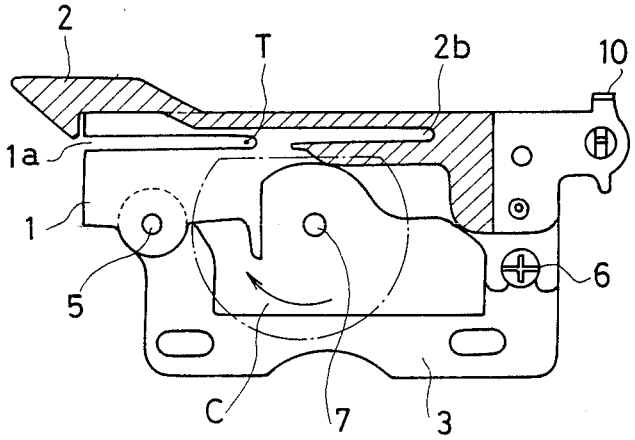
FIG. 2C is a sectional drawing viewed from arrow $A_1$–$A_2$ in FIG. 2A.
Figure 2D:
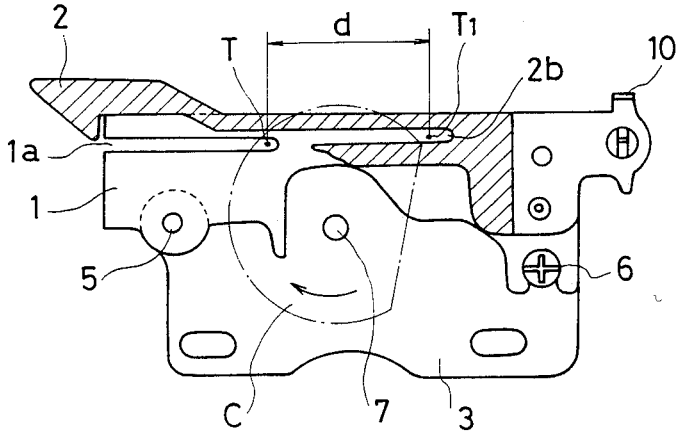
FIG. 2D is a modification of the drawing of FIG. 2C showing the cam rotated further and the thread moved rightwardly to the farthest point.

FIG. 1 also illustrates a second thread guide 2 which provides a slit 2*b* as shown in FIG. 2C. The looper thread T is transferred to the slit 2*b* when a cam C is rotated clockwise further as shown in FIG. 2D. Referring to FIG. 2D, mark $T_1$ illustrates the position of the thread when the thread is moved farthest rightwardly along the slit 2*b* by the clock-wise rotation of the cam C. The cam C may include a pair of eccentric semi-circular cam bodies. The distance d between T and $T_1$ indicates the thread feed per one rotation of the cam. A cam shaft 7 is also shown in FIG. 1.

FIG. 1 further illustrates a support plate 3 which is fixed to a machine frame F by fasteners such as two screws 9. The support plate 3 supports the first thread guide 1 by means of a fastener such as screw 6 and a pin 5. Pin 5 pivots to both the first guide 1 and the support plate 3 such that the first guide 1 may be rotated counter-clockwise around the pin 5 by loosing the screw 6 when, for example, inside cleaning is required or in case malfunctioning of the cam operation has occured.

A thread tension mechanism 8 is also shown in FIG. 1. The thread tension mechanism 8 clamps the thread T (for example, with spring force) to give proper tension against the thread. The thread tension 8 can also be provided by a simple pin or a shaft such that the thread is hung and its feeding direction is reversed.

Numeral 10 in FIG. 1 illustrates a third thread guide. The third thread guide 10 may be provided by an L-shaped projection from the first guide 1 such that the thread T passes between this projection and the back-side wall of the first guide 1.

The introduction and guiding of the thread according to the above-described constitution of the rotary looper thread take-up will now be explained. First, the looper thread T is passed through the thread tension 8 (FIG. 1) and its feeding direction is reversed. The thread T is then introduced into the slit 1*a*, and after passing under the second guide 2, enters into another slit 1*a*. After passing through the another slit 1*a*, the thread T is turned at a right angle and advances along the back-side wall of the first guide 1, and passes through the third guide 10. The feeding direction of the thread T may be turned slightly when plan-viewed. The thread T may then be introduced to a looper (not shown).

Figure 3:
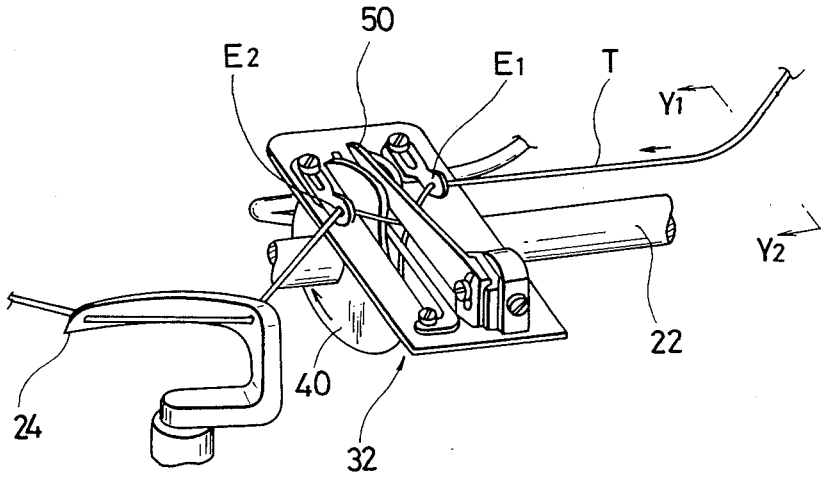
FIG. 3 (PRIOR ART)
FIG. 3 illustrates a conventional type of rotary looper thread take-up, this drawing being a partial view of FIG. 1 of U.S. Pat. No. 4,492,174.

Referring to the conventional looper shown in FIG. 3, in such a case, eyeing labor (i.e. the operator's labor to introduce the thread through $E_1$–$E_2$) is required. However, according to the instant invention, this eyeing labor is eliminated.

With the invention, the operator can easily clamp the thread T into the thread tension 8 by simply hanging the thread T around the thread tension 8 and pulling. The pass-in operation to the slit 1*a* is very easy since the first guide is U-shaped. Thus, the slit 1*a* is opened along this U-shaped wall and thereby there is only one opening for both the front-side slit 1*a* and back-side slit 1*a*. Passing the thread T through the third guide 10 is also easily accomplished. Since the third guide 10 is only a small L-shaped projected piece, the operator can easily lay the thread T down into this projection.

Thus, according to the invention, the operator can introduce the looper thread into the rotary looper thread take-up without eyeing labor and in an essentially one-step action. Hence, productivity is greatly improved.

Another advantage of the invention—the prevention of looper thread spinning—will be explained hereafter with reference to both the conventional thread take-up and the take-up according to the invention.

Figure 4:
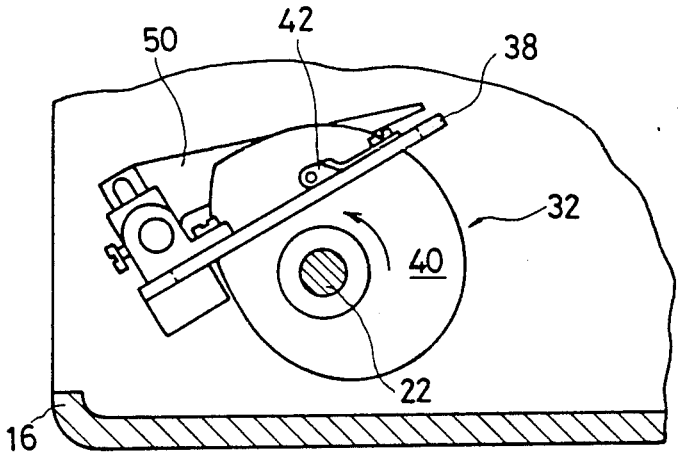
FIG. 4 (PRIOR ART)
FIG. 4 is a side view drawing of the embodiment of FIG. 3 viewed from arrow $Y_1$–$Y_2$ in FIG. 3, this drawing being essentially reproduced from FIG. 2 of U.S. Pat. No. 4,492,174.
Figure 5:
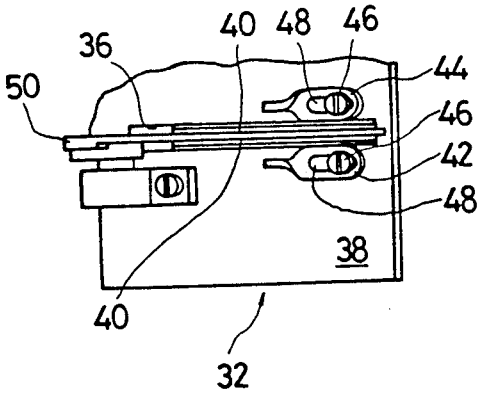
FIG. 5 (PRIOR ART)
FIG. 5 is a partial top plan view of the embodiment of FIG. 4, this drawing being essentially reproduced from FIG. 3 of U.S. Pat. No. 4,492,174.
Figure 7B:
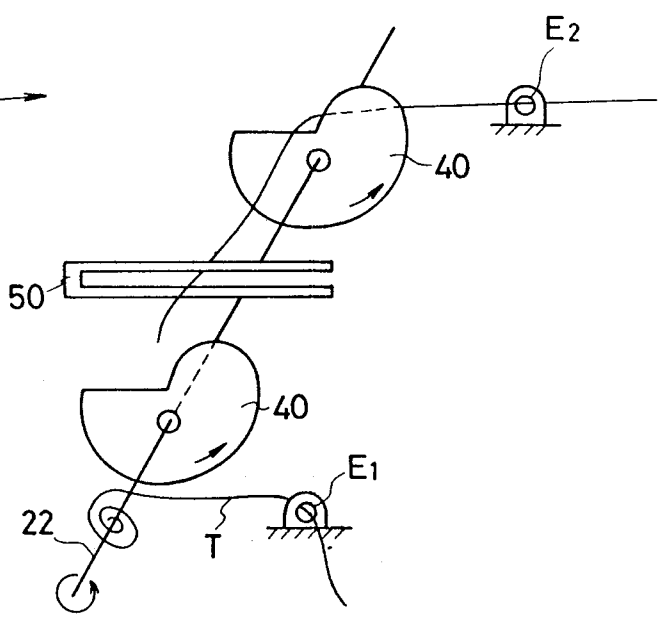
FIG. 7B (PRIOR ART)
FIG. 7B is a schematic drawing illustrating the condition of when a looper thread is broken, according to the prior art.
Figure 7A:
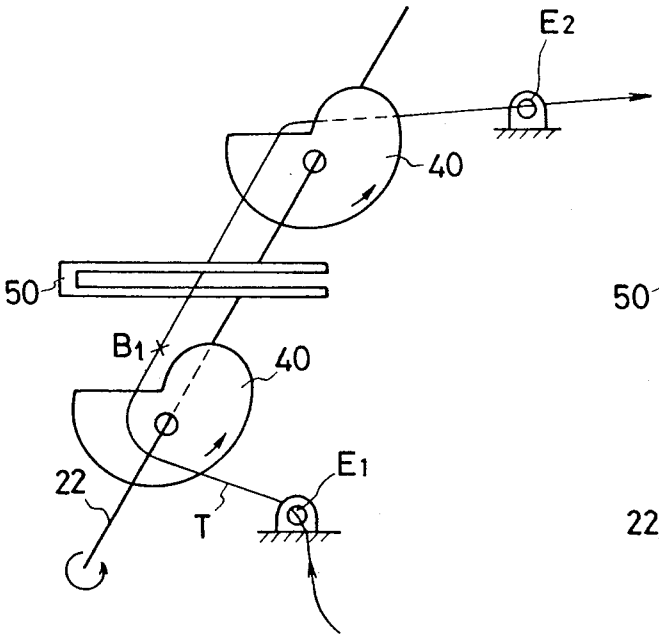
FIG. 7A (PRIOR ART)
FIG. 7A is a schematic drawing illustrating a prior art arrangement for guiding a looper thread to a rotary looper thread take-up.

Referring first to FIG. 7A, which illustrates the introduction of the looper thread T into a rotary looper thread take-up according to the prior art, the looper thread T in such a conventional apparatus is first eyed in eye $E_1$ (FIG. 3). Then, the looper thread T is passed under a stripping finger 50 as shown in FIGS. 3–5. The looper thread T is then eyed into another eye $E_2$. According to this conventional apparatus and procedure, as shown in FIGS. 3–5, 7A and 7B, if the looper thread T is broken at point $B_1$, (FIG. 7A) the looper thread T will hang on a cam shaft 22 and will be wound around the cam shaft 22 until the operator notices the break. A large quantity of thread may thus be wound-up (see FIG. 7B), requiring a long period of time to remove the wound thread.

Figure 6B:
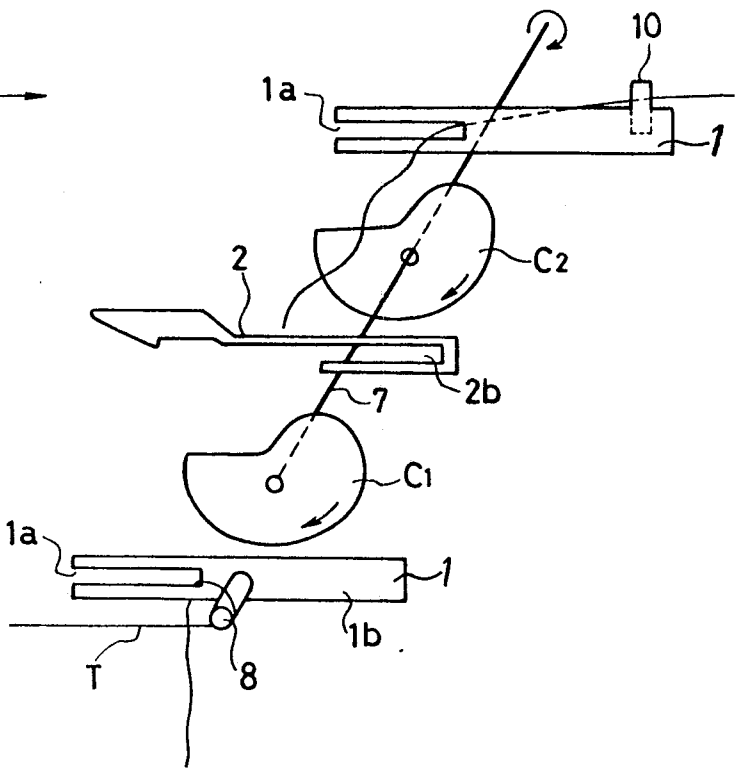
FIG. 6B is a schematic drawing illustrating the condition of when a looper thread is broken, according to the invention.
Figure 6A:
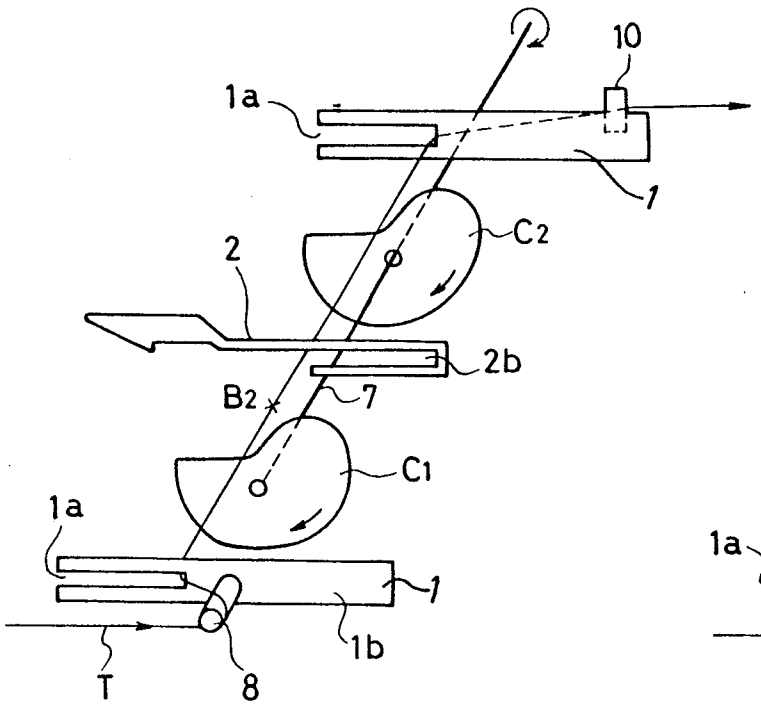
FIG. 6A is a schematic drawing illustrating an arrangement for guiding a looper thread to a rotary looper thread take-up according to the invention.

Referring to FIG. 6A, which illustrates the introduction of the looper thread into the rotary looper thread take-up according to the instant invention, first the looper thread is hung on the thread tension 8 and is then turned back. (Since the thread tension 8 can be substituted by a simple pin or a small short shaft as aforementioned, in this drawing, a shaft 8 is shown.) The looper thread T is then introduced into the slit 1*a* of the first guide 1. Since the end of shaft 7 does not extend outwardly to slit 1*a* of the guide means (see FIG. 6A), the thread is introduced through the guide means from a point past the end of the rotary shaft. Then, the looper thread is advanced to the another slit 1*a* passing under the second guide 2. The thread then turns at a right angle to advance along the back-side wall of the first guide 1, and passes through the third thread guide 10 and advances to a looper (not shown).

Under the aforementioned arrangement of a looper thread in an embodiment of the invention, if the thread T is broken at point $B_2$, the looper thread T turns downward and hangs at the edge of slit 1*a*, as shown in FIG. 6B. This result is achieved since the end of shaft 7 does not extend outwardly to the shaft 8 side of guide 1 and thus a free space is provided between the first guide 1 and the cam $C_1$ as shown in FIGS. 6A and 6B.

Thus, spinning of the looper thread is avoided, and productivity is very much improved.

Further, if the guide 8 (FIG. 6A) is substituted by a thread tension mechanism, the thread tension usually located between the thread supply source and the rotary looper thread take-up can be eliminated. In such a case, the thread tension mechanism will work both as the thread tensioner and as the turn-back guide.

As many apparently widely different embodiments of the invention may be made without departing from the spirit and scope of the invention, it is to be understood that the invention is not limited to the specific embodiments herein described and should be interpreted only in accordance with the claims which follow.

What is claimed is:

1. A rotary looper thread take-up, comprising:

a first thread guide which is U-shaped and has two parallel leg portions and a head portion connecting said leg portions, said first thread guide providing a slit defining an opening at the head portion thereof and extending along the leg portions of said first thread guide;

a second thread guide placed adjacent to the first thread guide in between and in parallel with said leg portions of the first thread guide;

a cam body placed in the space between said first thread guide and said second thread guide which transfers thread in a direction opposite to the head portion of said first thread guide such that the thread is fed into said second thread guide; and turn back means for providing thread tension, said turn back means fixed to the outside of one of said leg portions of the first thread guide and positioned in a direction opposite to the head portion of said first thread guide from the end of said slit.

2. A thread guiding device, as recited in claim 1, in which said turn back means comprises a thread tension means or device.

3. A rotary looper thread take-up, comprising:

a rotary shaft sustained rotatably by a machine frame and rotating in association with a main shaft;

cam means fixed to the end of said rotary shaft;

looper thread guide means sustained by said frame for guiding the looper thread to cross the rotational path-way of said cam means and in which the rotary shaft does not extend to the looper thread guide; and thread guide means sustained by said frame for introducing the looper thread from an outer side of the end of said rotary shaft through said looper thread guide means.

4. A rotary looper thread take-up, comprising:

a rotary shaft sustained rotatably by a machine frame and rotating in association with a main shaft and having at least one free end;

cam means fixed to said free end of said rotary shaft; and looper thread guide means sustained by said frame for guiding looper thread to cross the rotational path-way of said cam means, said looper thread guide means substantially surrounding said cam means such that a free space is provided between said looper thread guide means and said extreme free end of said rotary shaft.

5. A rotary looper thread take-up as recited in claim 4, in which said looper thread guide means has a U-shaped member with an elongated opening.

6. A rotary looper thread take-up, comprising:

a U-shaped first thread guide having two parallel leg portions, a head portion, and a slit defining an opening, said head portion connecting said leg portions;

a second thread guide placed between said two leg portions of the first thread guide and extending in parallel with said leg portions;

a cam body placed in a space between said first thread guide and said second thread guide for transferring thread into said second thread guide; and turn back means fixed to one of said leg portions of the first thread guide for turning back the looper thread.

7. A rotary looper thread take-up as recited in claim 6, in which a rotary shaft is connected to said cam body, wherein said rotary shaft does not extend to the first thread guide.

8. A rotary looper thread take-up as recited in claim 6, in which said turn back means comprises a thread tension device.

* * * * *